United States Patent [19]

Pletts

[11] 4,127,093

[45] Nov. 28, 1978

[54] EXHAUST RECYCLE MIXER

[75] Inventor: Donald C. Pletts, Palm Beach Shores, Fla.

[73] Assignee: Car-Bo-Tech Inc., Palm Beach Shores, Fla.

[21] Appl. No.: 775,834

[22] Filed: Mar. 9, 1977

[51] Int. Cl.[2] ..... F02M 25/06
[52] U.S. Cl. ..... 123/119 A
[58] Field of Search ..... 123/119 A, 141

[56] References Cited

U.S. PATENT DOCUMENTS

| | | | |
|---|---|---|---|
| 3,459,162 | 8/1969 | Burwinkle et al. | 123/141 X |
| 3,530,843 | 9/1970 | Fessenden | 123/119 A |
| 3,580,233 | 5/1971 | Busse | 123/119 A |
| 3,878,823 | 4/1975 | Vartanian | 123/119 A |

*Primary Examiner*—Wendell E. Burns
*Attorney, Agent, or Firm*—Sherman & Shalloway

[57] ABSTRACT

A fuel/air and recycled-exhaust mixer is disclosed which is devoid of valves or interruptions in the exhaust-recycle path and which is effective with multi-barrel and multi-stage carburetors, either as original equipment for new vehicles or as a conversion unit for existing vehicles.

8 Claims, 3 Drawing Figures

EXHAUST RECYCLE MIXER

BACKGROUND OF THE INVENTION

The present invention is concerned with charge-forming mixers for internal combustion engines and is concerned, more particularly, with exhaust-recycle mixers for conserving fuel and reducing pollutant emissions from such engines.

BRIEF DISCUSSION OF THE PRIOR ART

It has been known for many years that the efficiency of internal combustion engines is insufficient to prevent the loss of combustible matter of significant fuel values into the exhaust gases. Accordingly, many attempts have been made to find a successful manner in which to recycle a fraction of the exhaust gases to augment the fresh fuel incoming to the engine intake.

These attempts have had to accomodate the problems of hot-gas pre-ignition of the fuel, recycling of solids from the exhaust to the chambers of the engine, proper heating of the remix without overheating, and the proper proportioning of the exhaust-recycle and the incoming fuel.

Some of the earlier attempts in the mixing of fuel and a recycled exhaust portion are typified in the following U.S. patents:

U.S. Pat. No. 1,201,977 to Lovejoy
U.S. Pat. No. 1,382,285 to Harris
U.S. Pat. No. 1,440,956 to Ballenger
U.S. Pat. No. 1,568,642 to Thompson
U.S. Pat. No. 2,300,774 to Cartmell These patents employed various means to break up and intermix the flow of fuel and exhaust recycle including multiple perforations, intersecting angles of flow and random paths such as are provided by a substance like a steel wool in a mixing chamber.

However, mixers which impose a significant pressure drop or backpressure between the carburetor and the mixed-fuel intake involve a problem for engines which are to be operated under a wide variety of loads and circumstances, such as are encountered in contemporary automotive vehicles.

A mixer designed for optimum operation at one RPM may starve the engine at higher rpms or under conditions of heavy acceleration. Below the optimum RPM, the mixer is prone to supply a greater amount of whichever fuel source imposes the least resistance and may provoke a choked condition supplying excessive fresh fuel.

However, fuel mixers exhibiting relatively low backpressures are also well known and are typified by low-restriction, zig-zag or staggered flows. Early examples of such zig-zag fuel-charge mixers include, for example, the following U.S. patents:

U.S. Pat. No. 284,557 to Hopkins
U.S. Pat. No. 664,025 to Nash
U.S. Pat. No. 748,822 to Wallman
U.S. Pat. No. 2,188,072 to Brown Most recently, popular concern for minimizing air polution, as well as the increasing problems of fuel supply and fuel costs, have caused a renewed intensity of interest in finding a satisfactory system for recycling at least a satisfactory portion of the useable hydrocarbons and incompletely burned exhaust components to achieve both fuel economy and low emissions of undesireable gases.

Categorically, these recent attempts have tried to solve a very complex problem with collections of mechanical complexities which are so delicate of adjustment and so prone to fouling by the exhaust gases they recycle that they have been more successful in their sophistication of machinery and control stages than in their performance and practical utility and, consequently, their acceptance in commerce.

For example, U.S. Pat. No. 3,421,485 to Fessenden employs axial-flow fans and rotating homogenizers to draw exhaust gases and to impel them into mixture with fresh fuel.

U.S. Pat. No. 3,530,843 to Fessenden discloses a zig-zag blender having a special heat-conducting circuit and further complicated by two-stage check valves which control the flow of exhaust gases from the exhaust system to the mixing chamber.

A subsequent patent, U.S. Pat. No. 3,587,546 to Fessenden, discloses a fully pressurized fuel-metering unit which is intended to replace conventional carburetors, particularly in association with mixers or blenders.

Accordingly, prior systems for recycling exhaust-gas portions have relied upon mechanical complexities which provoke service problems or have invited the use of complex and expensive accessory items. Therefore, prior exhaust recycle systems have not been found to be entirely satisfactory.

SUMMARY OF THE INVENTION

In general, the preferred form of the present invention comprises a fuel/air duct defining a staggered flow path between a fuel/air carburetor and an intake of an internal combustion engine and providing for an uninterrupted flow path for recycled exhaust gases from a location in the exhaust system and through a separating chamber to the fuel/air duct for mixing with the fuel-/air mixture in the duct.

OBJECTS OF THE INVENTION

It is an object of the present invention to provide a mixer for fuel/air mixtures and exhaust-recycle portions which is simple and without frequent maintenance requirements.

It is another object of the present invention to provide a simple mixer for fuel/air mixtures and exhaust-recycle portions which will accomodate multi-stage carburation without requiring adjustments or compensation.

It is another object of the present invention to provide a simple, compact and versatile fuel, air and exhaust mixer which provides an uninterrupted recycle flow path for exhaust gases which is free of close tolerances and consequent obstruction by exhaust deposits.

It is still another object of the present invention to provide a simple exhaust-recycle and fuel charge mixer which accomodates solid components contained in the recycled exhaust gases and varying flow rates without close clearances and moving parts.

It is yet another object of the present invention to provide a simple exhaust-recycle and fuel charge mixer which will accomodate surges in the heat content of the recycled exhaust by absorption thereof in the body of the mixer prior to entrance into the mixing duct.

It is a particular object of the present invention to provide a mixer for combining fuel, air and recycled gas portions which is operable over substantial ranges of engine speeds and with multiple-stage carburation without valving the exhaust-recycle flow and while accomodating variations in entrained matter and heat content of the recycled exhaust.

BRIEF DESCRIPTION OF THE DRAWINGS

These and other objects of the invention, as well as a better understanding thereof, may be derived from the following description and accompanying drawings, in which.

DETAILED DESCRIPTION OF THE PREFERRED EMBODIMENT

Figure 1:
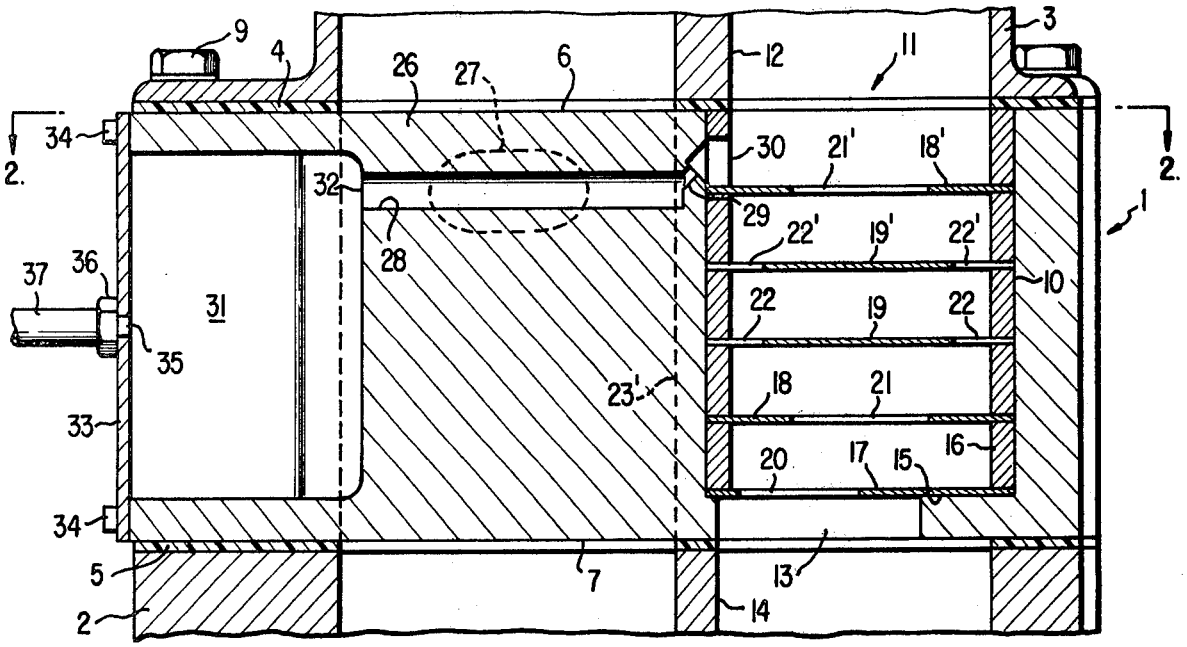
FIG. 1 is a sectional elevation of the preferred form of mixer.

As shown in the drawings, the preferred form of mixer of the present invention comprises a body 1 of cast aluminum alloy, or a comparable material, shaped to fit between an automotive intake manifold 2 and its appropriate carburetor 3 with interposed gaskets 4 and 5 closing against the adjacent flange surfaces 6 and 7 of the mixer body. The body also includes four bolt bores 8 for receiving assembly bolts 9 therethrough to engage mating fittings in the carburetor and manifold. As shown in the drawings, the mixer is shaped to fit the four-barrel carburetors of large-displacement, General Motors automotive engines.

The body 1 has a rectangular primary fuel/air duct 10 extended therethrough between an inlet 11 underlying the first-stage barrels 12 of the carburetor and an outlet 13 overlying the inlet 14 of the manifold. The outlet 13 of the primary duct is preferably rectangular, as shown, but may take any desired shape.

Figure 3:
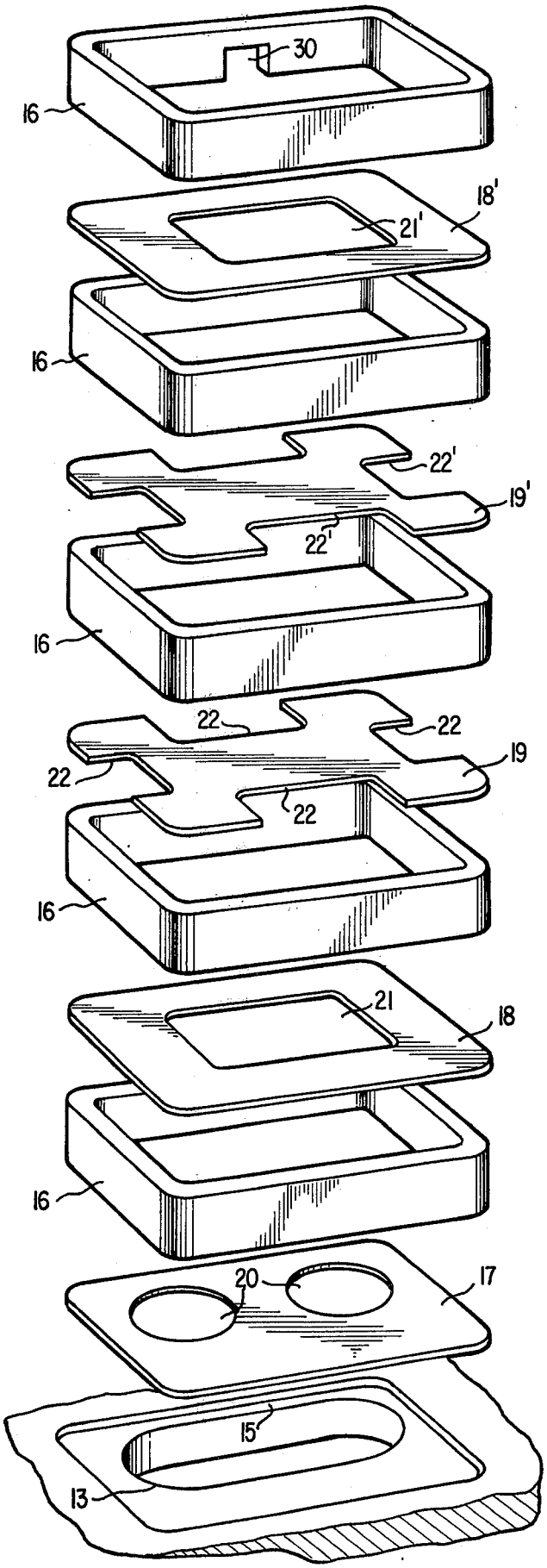
FIG. 3 is an exploded view of the staggered-flow insert of the mixing chamber.

Adjacent the outlet 13, the body has a ledge 15 supporting a series of alternating spacers 16 and plates 17–19 loosely positioned therein. As best shown in FIG. 3, the lowermost plate 17 has a pair of ports 20 overlying the outlet 13. The next plate 18 has a centered, rectangular port 21; the next two plates 19, 19′ have four notched ports 22 in their periphery and the uppermost plate 18′ has a centered, rectangular port 21′.

The spaced, inward and outwardly ported plates 17–18 thus provide a staggered or zig-zag flow path through the primary fuel/air duct and a consequent thorough mixing of the several components of the combustion charge passing through the duct. Other forms of staggered-flow assemblies may be employed, if desired, but the disclosed series of loose plates and loose, peripheral spacers are especially advantageous with regard to simplicity of cost and installation and their lack of service requirements. The overall assembly is simply retained in the primary fuel/air duct between the ledge 15 and a portion of the flange or gasket associated with the carburetor.

The body 1 also includes a pair of second-stage or secondary fuel/air ducts 23 and 23′ which are aligned with the outlets of the two second-stage barrels of the carburetor and communicate therewith via inlets 24, 24′ and with the intake manifold via outlets 25, 25; respectively. A wall 26 intermediate the secondary ducts 23 and 23′ has a thickened portion 27 in its upper region near the inlets 24 and 24′ and has a bore 28 of about one-fourth inch diameter extended therethrough to adjacent the primary duct 10. The upper portion of the primary duct 10 has a delivery bore 29 of about one-eighth inch diameter intersecting the bore 28 and opening the bore 28 to the inlet portion of the primary duct 10. The uppermost spacer 16 is notched or otherwise relieved as at 30, to provide free communication of the bore 29 and the primary duct.

Figure 2:
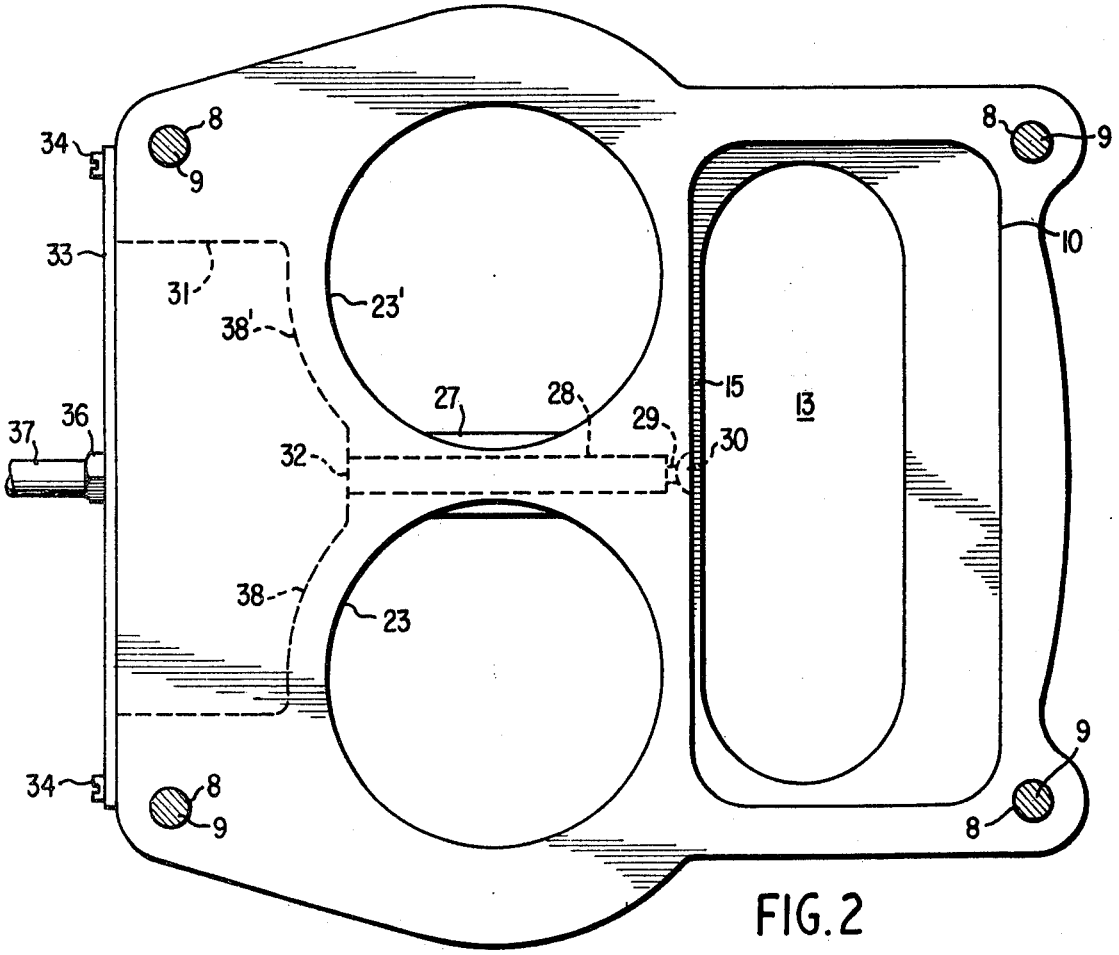
FIG. 2 is a plan view thereof and taken on lines 2—2 of FIG. 1.

As best shown in FIG. 2, the body includes a settling chamber 31 extended along and partially between the secondary ducts 23 and 23′ and in direct communication via a port 32 with the bore 28 which passes between the secondary ducts. The chamber 31 is closed by a plate 33 secured on the body by screws 34 about its periphery. The plate has a threaded inlet port 35 for receiving a fitting 36 associated with an exhaust return line 37. Preferably, the port 35 is located at a level below the level of the transfer port 32 and duct 28.

The chamber 31 thus includes a substantial volume and further provides for heat-transfer contact with the resulting thin, curvate walls 38, 38′ of the secondary ducts 23 and 23′.

In operation, the mixer is installed between the carburetor and manifold, as shown, and the tube 37 is connected to a point or points in the exhaust system intermediate the exhaust manifold and a muffler or resonator.

When the engine is then started, exhaust gases are drawn through an uninterrupted flow path from the point of connection in the exhaust system through to the inlet zone of the primary fuel/air duct 10. In the primary duct, the exhaust-recycle is thoroughly mixed with the fresh fuel/air mixture and delivered to the engine as part of the fuel charge.

Any particulate matter returned with the exhaust is free to fall out of entrainment in the enlarged settling chamber 31. Accumulations thereof may be removed quickly with a screwdriver at intervals coinciding with other services such as oil changes.

The intimate association of the returned gases with a large internal area of the mixer body allows the body to absorb heat freely from the gases, adjacent the second-stage ducts 23, 23′, before the recycled gases are presented to the fresh fuel/air mixture and thereby help accomodate fluctuations in exhaust-gas temperatures while retaining the heat value in the flow path of the carburation.

It is important to note that the mixer of the present system is the essence of simplicity, being entirely without metering valves, check valves or similar close-tolerance complications.

However, it is significant that, in spite of its simplicity and lack of complex and sensitive adjustments, the mixer of the present invention is capable of extremely effective performance of fuel economy and pollutant-reduction over a wide range of engine-operating conditions.

As stated before, the specific shape of the mixer disclosed in the drawings is intended for use with large-displacement, General Motors blocks. A mixer as disclosed herein has been so tested and proven most effective.

The test vehicle was a 1970 Cadillac Fleetwood having a 472CID engine, more than 70,000 miles, and its original four-barrel carburetor, a "Rochester Quadro Jet". The vehicle has a curb weight of 5,260 pounds.

When used in the "carburetor" tests reported below, the vehicle was thoroughly tuned for optimum gas mileage with the carburetor as installed at the factory.

In the "carb/mixer" tests, the vehicle was altered only by addition of the mixer intermediate the carburetor and intake and an exhaust take-off in the system to supply the exhaust recycle.

In the mileage tests, a one-gallon reservoir and a recently-checked speedometer were used for measurement, with the following average results:

| Carburetor | Carb/Mixer |
|---|---|
| "regular" fuel - 12.6 mph | 19.4 mph |
| "no-lead"fuel - 11.8 mph | 19.1 mph |

Accordingly, it is apparent that the present invention provides not only a dramatic increase in miles per gallon of gasoline, but accomplishes performance and economy with regular gas, instead of the high-octane premium gases normally necessary in that engine.

However, the mileage performance is only a part of the surprising results provided by the present invention. Emission analyses were conducted by a commercial test facility, in both the "carburetor" and "carb/mixer" configurations, with the following results:

| | Carburetor | | Carb/Mixer | |
|---|---|---|---|---|
| | Hydro-carbons | Carbon Monoxide | Hydro-carbons | Carbon Monoxide |
| Idle (650 rpm) | 2060 ppm | 4.10% | 40 ppm | 0.46% |
| Run (2500 rpm) | 2060 ppm | 10.12% | 30 ppm | 0.04% |

Therefore, it is apparent that the new mixer drastically reduces the hydrocarbon and carbon monoxide contents of the exhaust gases finally emitted, to the point that a seven year old car with more that seventy thousand miles can operate well below the upper limits for hydrocarbons (250 - 280 ppm) and for carbon monoxide (1.5 - 2.5%) now specified or forthcoming in some of the more severe jurisdictions. This is accomplished without catalytic converters or other complexities or sophistications.

The present invention thus provides a simple exhaust recycle system which equals or exceeds the performances of the more complex prior systems.

Various changes may be made in the details of the invention, as disclosed, such as adaptation to different carburetors and engines, without sacrificing the advantages thereof or departing from the scope of the appended claims.

What is claimed is:

1. A charge-forming mixer for internal combustion engines having a carburetor, an intake member and an exhaust member, said mixer comprising
   - a body having
   - at least one fuel/air duct extended therethrough, said fuel/air duct having
   - an inlet for receiving a fuel/air mixture from the carburetor and
   - an outlet for discharging a combustible mixture therefrom to the intake member,
   - means defining a staggered flow path for fluids passed enroute from said inlet to said outlet,
   - a settling chamber on a side of said body remote from said fuel/air duct,
   - a transfer duct extended in heat transfer relationship through a wall of said body, said duct including,
   - a transfer aperture communicating with said settling chamber and
   - a delivery aperture in communication with said fuel-/air duct adjacent said inlet, and
   - recycling means for recycling a portion of the exhaust gases from the exhaust member to the settling chamber, said recycling means including an unobstructed recycle path free of valves.

2. A charge-forming mixer according to claim 1 in which said settling chamber is formed internally in said body.

3. A charge-forming mixer according to claim 2 in which said recycling means includes an exhaust inlet port positioned in said settling chamber at a level below said transfer aperture.

4. A charge-forming mixer according to claim 3 in which said body includes a second fuel/air duct and said transfer duct is positioned at least in part in a wall between said first and second fuel/air ducts.

5. A charge-forming mixer according to claim 3 in which said body includes first and second secondary fuel/air ducts positioned to receive a supplemental flow of fuel and air, and said transfer duct is positioned at least in part in a wall separating said secondary ducts.

6. A charge-forming mixer according to claim 5 in which said settling chamber is positioned at least partially intermediate said secondary fuel/air ducts and in close heat-transfer relationship therewith.

7. A conversion unit for engines having four-barrel, two-stage carburetors comprising
   - a body having
   - a carburetor flange and
   - an intake flange,
   - a primary fuel/air duct opening between said flanges and positioned to underly said primary carburetor barrels,
   - means defining a staggered flow path for fluids passed through said primary fuel/air duct,
   - a pair of secondary fuel/air ducts positioned individually to underly the secondary third and fourth barrels of the carburetor and opening between said flanges,
   - a settling chamber adjacent said secondary fuel/air ducts,
   - a transfer duct within a wall separating said pair of secondary fuel/air ducts,
   - said transfer duct including
   - a transfer aperture communicating with said settling chamber and
   - a delivery aperture communicating with said primary fuel/air duct adjacent said inlet, and
   - means for freely admitting recycled exhaust gases into said settling chamber for unobstructed passage into said primary fuel/air duct via a recycle path free of valves.

8. A conversion unit according to claim 7 in which said settling chamber is integral with said body and has a portion positioned at least partially intermediate said secondary fuel/air ducts.

* * * * *